US011661251B2

(12) United States Patent
Nicholls et al.

(10) Patent No.: US 11,661,251 B2
(45) **Date of Patent: *May 30, 2023**

(54) NOZZLE

(71) Applicant: LAVAZZA PROFESSIONAL NORTH AMERICA, LLC, West Chester, PA (US)

(72) Inventors: Darren Nicholls, Basingstoke (GB); Simon Wilson, Basingstoke (GB)

(73) Assignee: LAVAZZA PROFESSIONAL NORTH AMERICA, LLC, West Chester, PA (US)

( * ) Notice: Subject to any disclaimer, the term of this patent is extended or adjusted under 35 U.S.C. 154(b) by 77 days.

This patent is subject to a terminal disclaimer.

(21) Appl. No.: 17/319,422

(22) Filed: May 13, 2021

(65) Prior Publication Data

US 2021/0261300 A1 Aug. 26, 2021

Related U.S. Application Data

(63) Continuation of application No. 16/330,714, filed as application No. PCT/GB2017/052597 on Sep. 6, 2017, now Pat. No. 11,014,717.

(30) Foreign Application Priority Data

Sep. 6, 2016 (GB) ..... 1615069

(51) Int. Cl.

| | |
|---|---|
| ***B65D 47/10*** | (2006.01) |
| ***B65D 75/58*** | (2006.01) |
| ***B65D 85/804*** | (2006.01) |

(52) U.S. Cl.
CPC ..... *B65D 47/10* (2013.01); *B65D 75/5883* (2013.01); *B65D 85/8043* (2013.01)

(58) Field of Classification Search
CPC . B65D 47/10; B65D 75/5883; B65D 85/8043
USPC ..... 222/212, 541.3, 541.4
See application file for complete search history.

(56) References Cited

U.S. PATENT DOCUMENTS

| | | | | |
|---|---|---|---|---|
| 1,321,411 A | | 1/1918 | Alo | |
| 2,577,980 A | | 12/1951 | Sandler | |
| 4,886,674 A | | 12/1989 | Seward | |
| 5,160,327 A | * | 11/1992 | Stines | A61M 25/10182 604/920 |

(Continued)

FOREIGN PATENT DOCUMENTS

| | | | | |
|---|---|---|---|---|
| CN | 1309614 A | * | 8/2001 | B65D 47/10 |
| CN | 1309614 A | | 8/2001 | |

(Continued)

*Primary Examiner* — James N Smalley
(74) *Attorney, Agent, or Firm* — The Belles Group PC

(57) ABSTRACT

A nozzle, such as a nozzle for use as a part of a beverage preparation package. The nozzle may include a nozzle body with a conduit, the conduit having an inlet end and an outlet end. The nozzle may also include a plug that is connected to the nozzle body in a detachable manner. The plug and the conduit may be configured such that, when the plug is detached from the nozzle body, the plug is adapted to travel along the conduit and be retained within the conduit at the outlet end such that fluid can flow through the conduit from the inlet end towards the outlet end.

19 Claims, 3 Drawing Sheets

(56) References Cited

U.S. PATENT DOCUMENTS

Figure 2B:
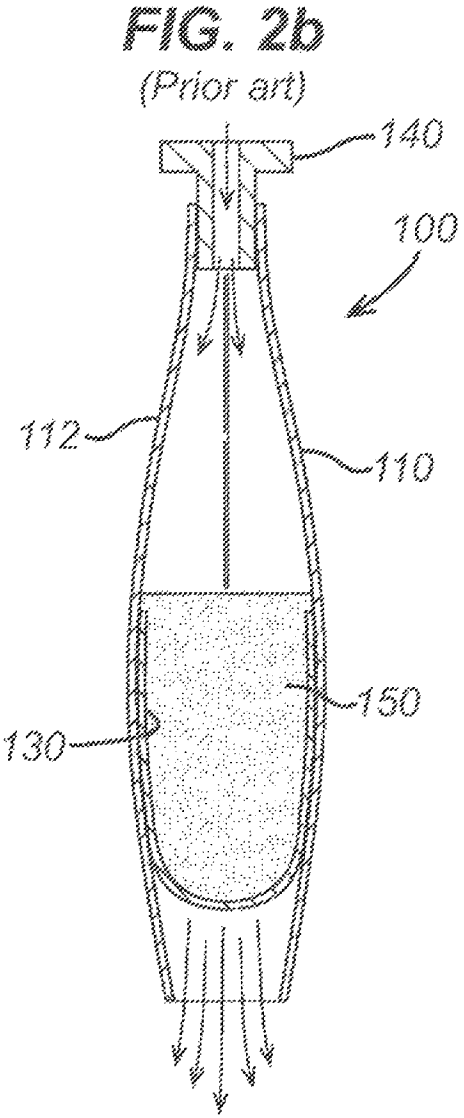
FIG. 2b (Prior art)

| | | | | | |
|---|---|---|---|---|---|
| 5,472,123 | A * | 12/1995 | Jangaard | B65D 1/023 222/212 |
| 5,547,303 | A | 8/1996 | Pyrozyk | |
| 5,817,064 | A * | 10/1998 | DeMarco | A61M 5/3271 604/232 |
| 6,358,545 | B1 | 3/2002 | Chandler | |
| 7,886,921 | B2 * | 2/2011 | Long | B65D 51/20 215/253 |
| 7,959,032 | B2 * | 6/2011 | Bolli | B65D 5/748 222/93 |
| 2005/0166763 | A1 | 8/2005 | Scarchilli | |
| 2006/0065127 | A1 | 3/2006 | Dalton | |
| 2006/0151417 | A1 | 7/2006 | Fuchs | |
| 2006/0201905 | A1 * | 9/2006 | Perrin | B29C 45/4407 220/254.1 |
| 2007/0221687 | A1 * | 9/2007 | Phillips | B65D 47/2062 222/500 |
| 2009/0004335 | A1 | 1/2009 | MacMahon | |
| 2010/0303964 | A1 | 12/2010 | Beaulieu | |
| 2013/0017303 | A1 | 1/2013 | Vu | |
| 2014/0144938 | A1 | 5/2014 | Kakuta et al. | |
| 2016/0052706 | A1 | 2/2016 | Talon | |
| 2017/0275090 | A1 | 9/2017 | Dubesset | |
| 2017/0275091 | A1 | 9/2017 | Vivier | |

FOREIGN PATENT DOCUMENTS

| | | | | |
|---|---|---|---|---|
| CN | 105102337 | A | 11/2015 | |
| CN | 105102337 | A * | 11/2015 | A45D 19/02 |
| EP | 1510468 | A1 * | 3/2005 | B65D 47/247 |
| EP | 1510468 | A1 | 3/2005 | |
| EP | 2692308 | A1 | 2/2014 | |
| EP | 2692308 | A1 * | 2/2014 | A61C 5/64 |
| EP | 3042861 | A1 * | 7/2016 | B65D 47/06 |
| EP | 3042861 | A1 | 7/2016 | |
| GB | 2327932 | A * | 2/1999 | B65D 49/04 |
| GB | 2327932 | A | 2/1999 | |
| JP | 2011-140330 | A | 7/2011 | |
| JP | 2011140330 | A * | 7/2011 | |
| KR | 20030036337 | A | 5/2003 | |
| KR | 20030036337 | A1 * | 5/2003 | |
| WO | WO 00/63080 | A2 | 10/2000 | |
| WO | WO-0063080 | A2 * | 10/2000 | B65D 75/5883 |
| WO | WO 03/022690 | A2 | 3/2003 | |
| WO | WO-03022690 | A2 * | 3/2003 | B65D 47/141 |

* cited by examiner

NOZZLE

CROSS-REFERENCE TO RELATED PATENT APPLICATIONS

The present application is a continuation of U.S. patent application Ser. No. 16/330,714, filed Mar. 5, 2019, which is a United States national stage application under 35 U.S.C. § 371 of PCT Application No. PCT/GB2017/052597, filed Sep. 6, 2017, which claims priority to United Kingdom Patent Application No. 1615069.0, filed Sep. 6, 2016. The disclosures of the aforementioned priority applications are incorporated herein by reference in their entireties.

The present invention relates to a nozzle. In particular, a nozzle for use as part of a beverage preparation package. The present invention also relates to a method of forming this nozzle.

Nozzles find numerous uses in applications that require the conveyance of fluids. One exemplary application is as part of a beverage preparation package, such as described in EP0179641A2. Such a beverage preparation package incorporates a nozzle within the package body. The nozzle serves the function of a water inlet for the package that can be securely held by the brewing machine. Water is injected through the nozzle into the package body in order to prepare the beverage ingredients contained inside.

It is desired that the nozzle is closed, and preferably sealed, prior to the injection of liquid into the beverage preparation package. In the past, this has been achieved by adhering a foil member over the nozzle inlet. The foil can then be pierced by a water injection member of a beverage brewing machine. An alternative approach involves forming the nozzle with an integral sealed end. This integral sealed end is then pierced by the water injection member of the beverage brewing machine so that water can be injected into the beverage preparation package.

The use of a foil member to seal the inlet requires an additional step during the manufacture of the nozzle and thus adds significantly to the cost of nozzle production. The alternative approach, as detailed above, is to injection mould a single-piece nozzle that is sealed integrally at one end. This approach limits the configuration options for the open end of the nozzle, since during the injection moulding process a pin has to be positioned to form the nozzle conduit. Following formation of the injection moulded nozzle the pin has to be removed via the open end. Hence, the configuration of the open end has to be designed to permit pin removal. This generally limits the opening of the nozzle to be relatively wide and directed along the direction of the conduit.

It is therefore an object of the present invention to produce nozzles that remove the need for a secondary sealing step whilst still allowing flexibility in the configuration of the non-sealed end of the nozzle. Such configuration flexibility allows the optimisation of the flow pattern of fluid leaving the nozzle.

Accordingly, the present invention provides a nozzle comprising a nozzle body having a conduit, wherein the conduit has an inlet end and an outlet end; and a plug connected to the nozzle body and obstructing the inlet end, wherein the plug is connected to the nozzle body in a detachable manner; wherein the plug and the conduit are configured such that, when the plug is detached from the nozzle body, the plug is adapted to travel along the conduit and be rentained within the conduit at the outlet end such that fluid can flow through the conduit from the inlet end towards the outlet end.

This configuration of nozzle provides a plug that seals the nozzle prior to use. In use, the plug of the nozzle is detached from the nozzle body by, for example, applying a force to the plug. The plug then travels along the nozzle body's conduit. When the plug reaches the outlet end, it does not leave the nozzle. Instead, the plug is retained at the outlet end of the nozzle body. It is held at the conduit outlet end in such a manner that it does not block the flow of fluid from the inlet end towards the outlet end. In this manner, the plug becomes part of the configuration of the outlet end and can then influence the flow pattern of fluid leaving the outlet end. Further, the retention of the plug at the outlet end ensures that the plug is not removed with the fluid. This is particularly advantageous in applications such as a beverage brewing package where it is preferred that the plug does not mix with the beverage preparation ingredients in the package, since it could either end up in the final beverage or may partially block a filter element within the package.

As described above, the retention of the plug ensures that the plug does not leave the outlet end of the nozzle. However, the plug may be capable of traveling within the conduit back towards the inlet end. In this sense, the plug is not fixed in position. In use, the plug is inhibited from traveling within the conduit back towards the inlet end by the flow of fluid through the nozzle and, possibly, the influence of gravity.

The nozzle described herein in a general sense is an article for directing the flow of a fluid. Accordingly, it has a conduit within the nozzle body. The conduit being a passage-way through which fluid can flow.

The nozzle body may be formed from any material that is impermeable to the fluid with which the nozzle is intended to be used. It is particularly preferred that the nozzle body is formed by injection moulding. Accordingly, it is preferred that the nozzle body is made from an injection mouldable material. Particularly preferred are injection mouldable plastics, in particular polypropylene or polyethylene. Polypropylene is the most preferred.

In the present invention the conduit has an inlet end and an outlet end. The notion of an end as either an inlet end or an outlet end does not limit the invention to only allowing fluid flow in one direction. The terms inlet end and outlet end are simply used to assist in describing the function of the nozzle. Specifically, the inlet end is the end of the nozzle at which, in use, fluid is preferably injected (and, in the specific use of a beverage brewing package, at which fluid is injected), and the outlet end is the end of the nozzle which, in use, fluid preferably flows towards (and, in the specific use of a beverage brewing package, towards which fluid does flow).

As noted above, the nozzle comprises a plug connected to the nozzle body and obstructing the inlet end of the conduit. In this way, the plug can impede the passage of material through the conduit. It is preferred that a plug seals the inlet end of the nozzle body so that no material can pass through the conduit, for instance during storage and/or prior to use. In this way, the nozzle can ensure that fluid flow is blocked prior to the point at which it is desired to flow. When the nozzle is part of a beverage preparation package, the seal can ensure that the beverage preparation ingredients remain inside the beverage preparation package body and that their freshness is maintained. It will be appreciated that, prior to use, the plug is positioned at the inlet end. It is suitably positioned so that it can be manipulated with an element originating from outside of the nozzle.

The plug may be positioned fully within the conduit. In other words, no part of the plug protrudes from the inlet end of the conduit. This ensure that a force is not accidentally applied to the plug that may detach the plug from the nozzle body prematurely.

As noted above, the plug is connected to the nozzle body in a detachable manner. The detachable manner allows the plug to be disconnected from the nozzle body so as to result in a discrete plug and a discrete nozzle body component.

The plug may be connected to the nozzle body via an adhesive where the adhesive bond can be overcome by applying a force to the plug that is sufficient to break the adhesive bond. Alternatively, the plug may be connected to the nozzle body via a portion of material. The portion of material is made relatively weak by being, for example, sufficiently thin so that a force applied to the plug can detach the plug from the nozzle body. This portion of material can be a continuous portion of material around the periphery of the plug when the plug is positioned within the conduit. It is preferable that the plug and the portion of material are the same material as the nozzle body. In this way, the nozzle body, the portion of material and the plug can be formed as an integral article, suitably by a single manufacturing process. This results in corresponding cost savings.

As noted above, the plug can be disconnected from the nozzle body by a force applied to the plug. The force required to disconnect the plug may be greater than 10 newtons, or greater than 20 newtons, and preferably greater than 25 newtons. This ensures that the plug will not accidentally detach during normal handling of the nozzle. The force required to disconnect the plug may be less than 100 newtons, or less than 85 newtons, and preferably less than 75 newtons. This ensures that the plug can be easily and simply removed by mechanical action. It is therefore preferred that the force required to disconnect the plug is in the range of 25 newtons to 75 newtons.

Following the detachment of the plug from the nozzle body, the plug is able to travel along the conduit in the direction of the outlet end. Accordingly, the detached plug is sized to be smaller than the conduit that is immediately downstream (i.e. towards the outlet end) of its attached position so that it can move through the conduit. Such travel may be assisted by gravity or the flow of fluid entering the inlet end. The plug is restrained from further travel at the outlet end of the conduit. In other words, the plug is stopped from leaving the outlet end of the nozzle body's conduit. This can be achieved by restricting the bore or cross-sectional area of the conduit at the outlet end.

Although, in use, the plug is retained at the outlet end of the conduit, the plug and conduit are configured such that fluid can still flow through the conduit from the inlet end towards the outlet end. Preferably, the plug and the conduit are configured such that the conduit further comprises one or more opening(s) (i.e. one or more opening(s) which are additional to the inlet and outlet ends) which, in use, remain unobstructed. Moreover, the plug retained at the outlet end influences the flow of fluid from the outlet end and so can be configured to provide the required fluid flow pattern exiting the nozzle.

The precise configuration of the plug and the conduit is not particularly limited as long as it allows the plug to move through the nozzle body conduit and be retained at the outlet end while not blocking the flow of fluid from the inlet end towards the outlet end. Multiple ways of achieving this are possible and particularly preferred ways of implementing this feature are considered herein.

The plug may have a shape that tapers in the direction of the outlet end. In other words, the width of the plug decreases along the length of the plug in the direction of a line running from the inlet end to the outlet end. Such a tapered shape assists the plug to move in the direction of the taper, i.e. towards the outlet end. The plug may be substantially conical in shape. Such a conical shape is particularly effective at ensuring that the plug can move easily along the conduit when it is detached from the nozzle body. The substantially conical shape may a frustoconical shape.

The plug may have a shape that tapers in the direction of the inlet end, as well as tapering in the direction of the outlet end. This results in a shape with a maximum width at some point along its length away from the ends. This reduces the portion of the plug that has the maximum width and so assists the plug to move along the conduit. It is preferred that the plug is connected to the nozzle body at its point of maximum width.

The plug may have a length that is longer than the maximum width of the conduit through which it will travel. In this way the orientation of the plug should be substantially maintained as it travels through the conduit.

The shape of the plug is suitably complementary to the shape of the conduit. It is particularly preferred that the plug and the conduit both have a circular cross-section. Such a symmetrical shape ensures good sealing of the conduit and assists with the subsequent movement of the plug along the conduit.

The conduit may be tapered at the outlet end. Such tapering can assist in retaining the plug at the outlet end. In other words, the width of the conduit reduces at the outlet end towards the outlet end point. The conduit is tapered such that the width of the conduit before the taper is large enough to allow the plug to travel through the conduit but tapers to a diameter less than the size of the plug so the plug is prevented from leaving the conduit via the outlet end. When the plug has a substantially conical shape the tapering of the outlet end of the conduit can be complementary to the plug's conical shape. In this way, the plug is securely held at the outlet end in a consistent position.

The conduit may have an opening at the outlet end, wherein the nozzle body and the plug are configured such that the plug can sit within the opening when it is retained at the outlet end. In this manner, the plug can be retained in a particular location enhancing the consistency of the fluid flow pattern from the nozzle.

As stated above, the plug is retained at the outlet end in such a manner that fluid can flow through the conduit from the inlet end towards the outlet end. To achieve this, the conduit suitably comprises one or more opening(s), such as perforations or slots, along its length. The opening(s) provide exit point(s) for fluid flowing through the conduit from the inlet end towards the outlet end The configuration of the nozzle body and the plug determines the relative position of the retained plug at the outlet end and thus influences the shape and size of the opening(s) through which fluid can leave the conduit. Preferably, such opening(s) are located such that the major fraction of the open area of the opening (s) is closer to the outlet end than the inlet end. Thus, it is preferred that the opening(s) are located such that the major fraction of the open area of an, each or all opening(s) is closer to the outlet end than the inlet end. It will nevertheless be appreciated that conduits comprising opening(s) at least part of which are located in the region of the conduit closer to the inlet end are within the scope of the present invention. The number of openings can be chosen to produce the desired flow pattern of fluid leaving the conduit.

In one preferred configuration, at least one slot extends partially along the length of the conduit. Thus, the length of said at least one slot is preferably less than the length of the conduit. Preferably, the slot(s) are located such that the major fraction of the open area of the slot(s) is closer to the outlet end than the inlet end. It is possible to have one slot extending along the conduit, or two slots, or three slots, or four slots, or five slots, or six slots, or more than six slots.

Where the conduit comprises multiple openings (preferably slots), the dimensions of each opening can be the same or different, but are preferably the same, particularly where symmetrical flow is desired. A particularly preferred embodiment comprises two openings (preferably slots), preferably two diametrically opposed openings (preferably slots). This produces an exit pattern of fluid from the nozzle that advantageously projects fluid in two opposite directions. Diametrically opposed openings (preferably slots) are positioned on opposite sides of the conduit. Alternatively, there may be four openings (preferably slots) which are evenly distributed around the conduit.

The plug may comprise grooves along its length. These grooves can assist the plug in travelling along the conduit by minimising the contact surface area between the plug and the conduit. The grooves may also extend along the full length of the plug's outer surface. In this manner, the grooves can form channels around the plug. When such a plug is used with a conduit with an opening into which the plug is contained, the channels allow the water to exit from the conduit. In this way, the pattern of the grooves along the surface dictates the flow pattern of the exiting fluid. The use of grooves can be combined with further outlets such as those in the form of the slots described above. Again, in this manner a particular flow pattern can be optimised.

It is preferred that the total open area through which fluid can exit from the nozzle in the conduit when the plug is contained at the outlet end is the same or greater than the total cross-sectional area of the conduit. In this way, a back pressure will not build up within the nozzle.

Also provided is a beverage preparation package comprising a package body containing a beverage ingredient; and a nozzle as described herein, wherein the nozzle is attached to the package body and the outlet end is positioned within the package body.

The nozzle described herein is particularly advantageous for a beverage preparation package since it has a plug that can obstruct the inlet end and so stop beverage preparation ingredient from exiting the package, for instance during storage or transport. Further, when the plug is detached it will not travel into the beverage preparation package but be contained within the nozzle and contribute to influencing the flow of fluid out of the outlet. This allows optimisation of the wetting of the beverage ingredient within the package and the clearing out of the beverage ingredient from the package.

The package body can be made of any material that is suitable for containing the beverage ingredient. It is preferable that the beverage package body is formed from substantially air and water impermeable material. In particular, the package body may be formed from a flexible plastics material. Further, the package body may be formed from a laminate material including an aluminium foil layer.

The nozzle is incorporated into the beverage preparation package such that the outlet end is positioned in the package body and the inlet end is positioned outside the package body. In this way, the nozzle directs fluid from outside the beverage preparation package to inside the package body in order to prepare the beverage within the beverage preparation package. The nozzle may be attached to the package body via an adhesive. Alternatively, the nozzle may be attached to the package body using welding.

In order for the prepared beverage to leave the beverage preparation package, the package body suitably further comprises a region that is releasable by heat and/or pressure. For example, the heat of the liquid that is introduced into the package body in order to prepare the beverage may cause the releasable region to open and allow the beverage to escape. Alternatively or additionally, the pressure associated with the injection of the liquid into the package body may lead to the opening of the releasable region.

The package body may comprise a front sheet and a back sheet, wherein the front sheet is bonded to the back sheet along the edges of the front and back sheet, and a nozzle is incorporated between the front sheet and the back sheet. The front sheet and the back sheet may be bonded together by ultrasonic welding.

When the beverage preparation package is formed from a front sheet and back sheet, the space within the package body containing the beverage ingredient is formed from the inner surface of the front sheet and the inner surface of the back sheet joined at the bonded edges. It has been found that the beverage ingredient can accumulate along the bonded edges. It is therefore advantageous for utilising all the beverage ingredient if the nozzle directs the fluid flow so as to clear the beverage ingredient from the edges of the package body. Accordingly, it is preferable that the nozzle is incorporated into the beverage preparation package such that it directs injected fluid towards the edges of the package body.

When the nozzle comprises diametrically opposed openings (preferably slots) as described above, this can be achieved by incorporating the nozzle such that the diametrically opposed openings are directed towards the bonded edges, as opposed to towards the inner surfaces of the front and back sheets. It is found that such an arrangement improves the utilisation of beverage ingredients in the package.

When the nozzle comprises four openings (preferably slots) that are evenly spaced around the conduit, two of the openings can be directed towards the bonded edges, while the other two openings can be directed to the inner surfaces of the front and back sheets. Alternatively, the openings can be directed at an angle relative to the direction of the bonded edges, for example 45 degrees.

Also provided is a method of forming a nozzle comprising the step of injection moulding the nozzle described herein, wherein a nozzle is a single-piece injection moulded article.

Injection moulding is a particularly preferred approach for producing the nozzle described herein. It provides a cost effective way of mass producing the claimed nozzle. The construction of the nozzle described herein is particularly advantageous for the injection moulding process. In particular, the plug that is formed at one end of the conduit is configured to obstruct the inlet end and also to be subsequently contained at the outlet end so as to influence the fluid flowing out of the nozzle.

The absence of a specific component at the outlet end for directing fluid frees up space at the outlet end during the manufacturing process. Therefore, a pin can be positioned to form the conduit as part of the injection moulding process and be subsequently removed via the outlet end. It has not been previously possible to form both a sealed end and a configuration for directing fluid from the outlet in a single-piece article. The ability to perform the injection moulding process in one step and form a finished nozzle decreases the cost of manufacture.

When the conduit is tapered at the outlet end, the nozzle body is suitably flexible in order to allow the removal of the pin at the end of the injection moulding process. This flexibility is suitably predominately elastic in nature to ensure that the taper is restored after the pin is removed. The flexibility can be provided by the presence of at least one slot extending along the length of the conduit, as described above. The slot can be present all the way to the end of the conduit. In this way, the sections of the outlet end can move apart. It is preferred that at least two slots are present extending along the conduit, where each of the slots is present all the way to the end of the conduit. In this manner, the outlet end of the conduit is partly in the form of legs of the nozzle body. These legs are then capable of flexing away from each other in order to allow the pin to be removed after the injection moulding process.

The wall of the tapered section of the conduit may be relatively thin compared to the rest of the conduit wall. This enables the tapered section to have improved flexibility relative to the rest of the nozzle.

The invention will now be described with reference to the following drawings

Figure 1:
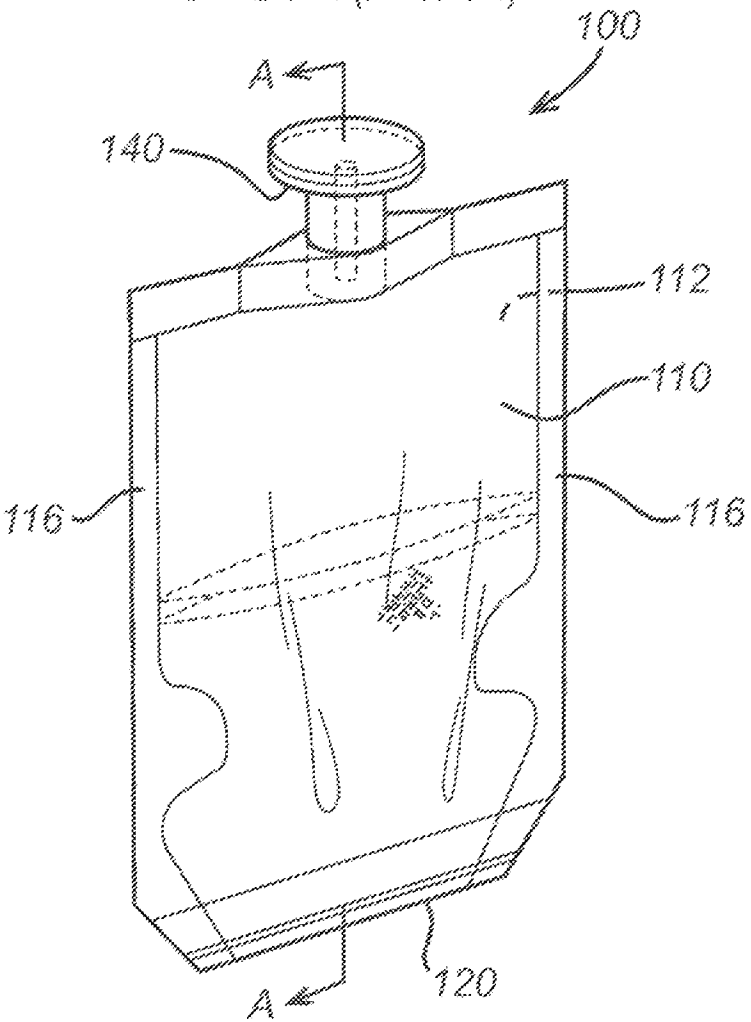
FIG. 1 (Prior art)

FIG. 1 is a perspective view of a beverage preparation package of the prior art.

Figure 2A:
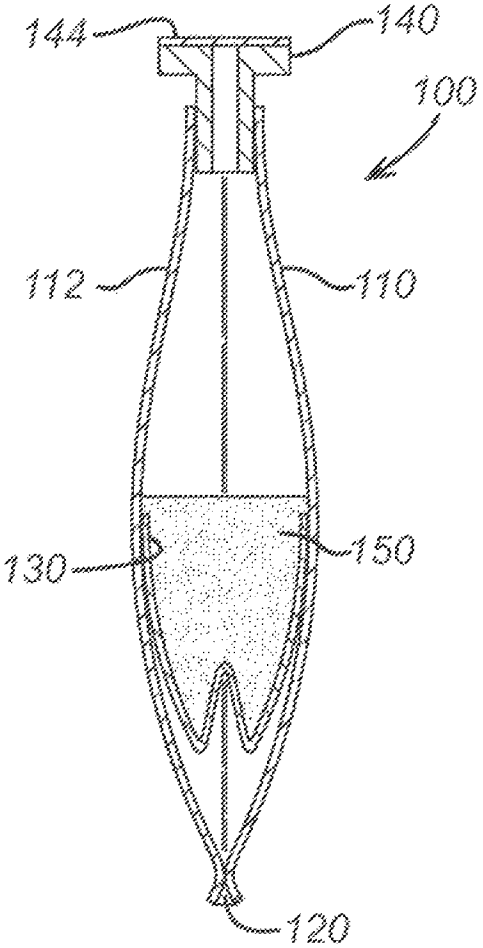
FIG. 2a (Prior art)

FIG. 2*a* is a cross-sectional view of a beverage preparation package of the prior art depicted in FIG. 1.

FIG. 2*b* is a cross-sectional view of the beverage preparation package of FIG. 1 during use.

Figure 3A:
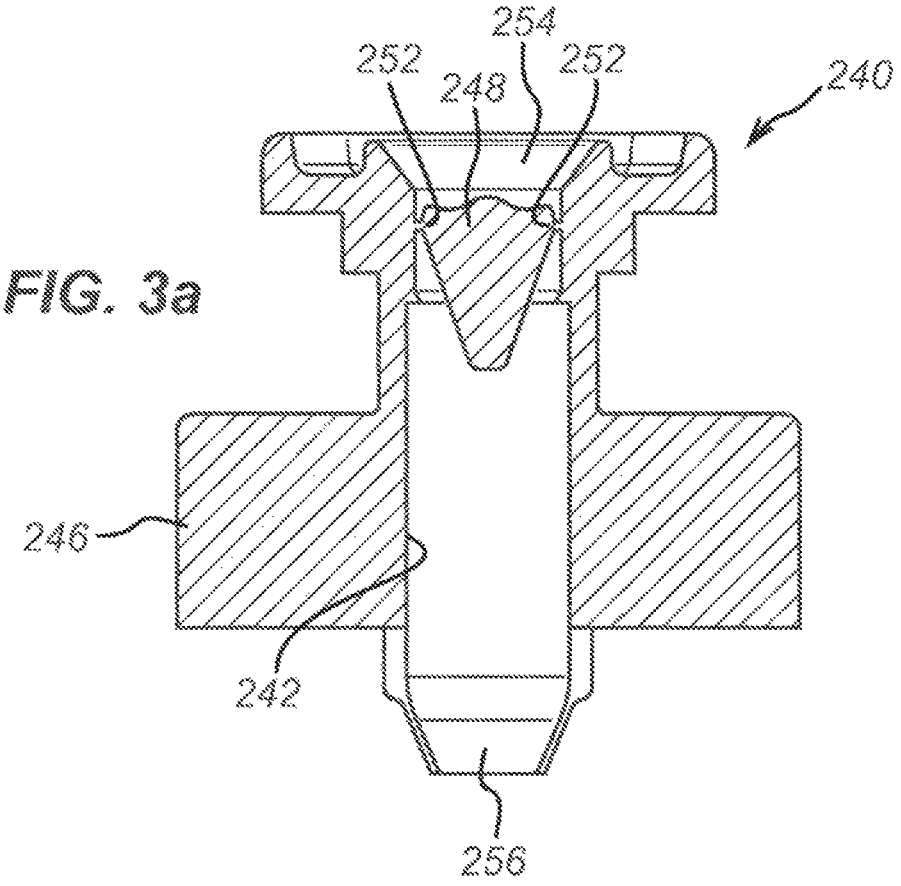

FIG. 3*a* is a cross-sectional view of a nozzle of the present invention.

Figure 3B:
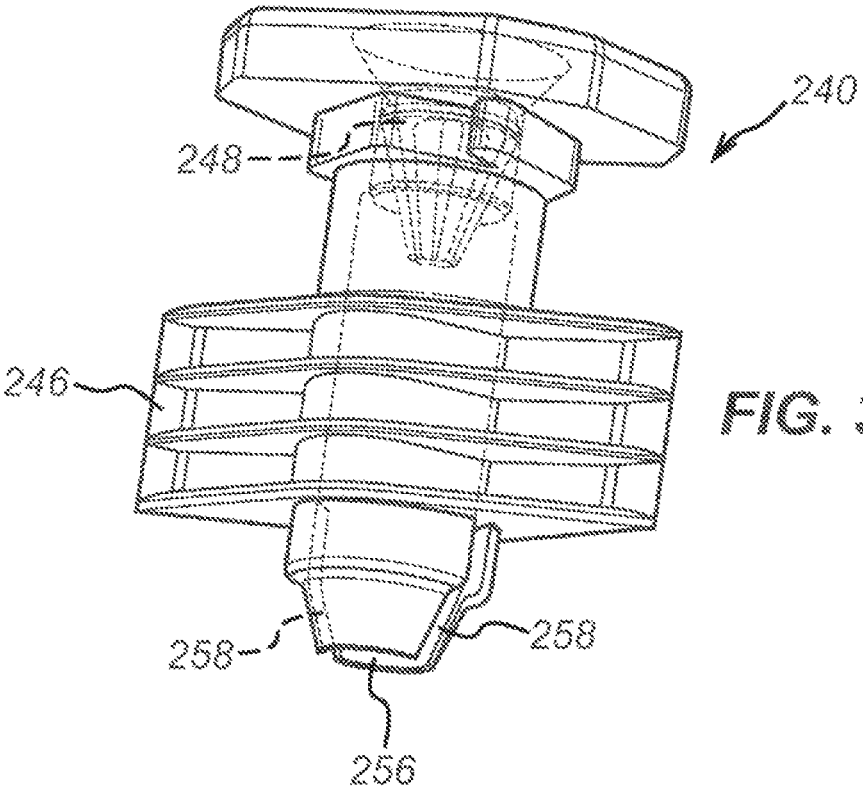

FIG. 3*b* is a perspective view of the nozzle of the present invention depicted in FIG. 3*a*.

Figure 4A:
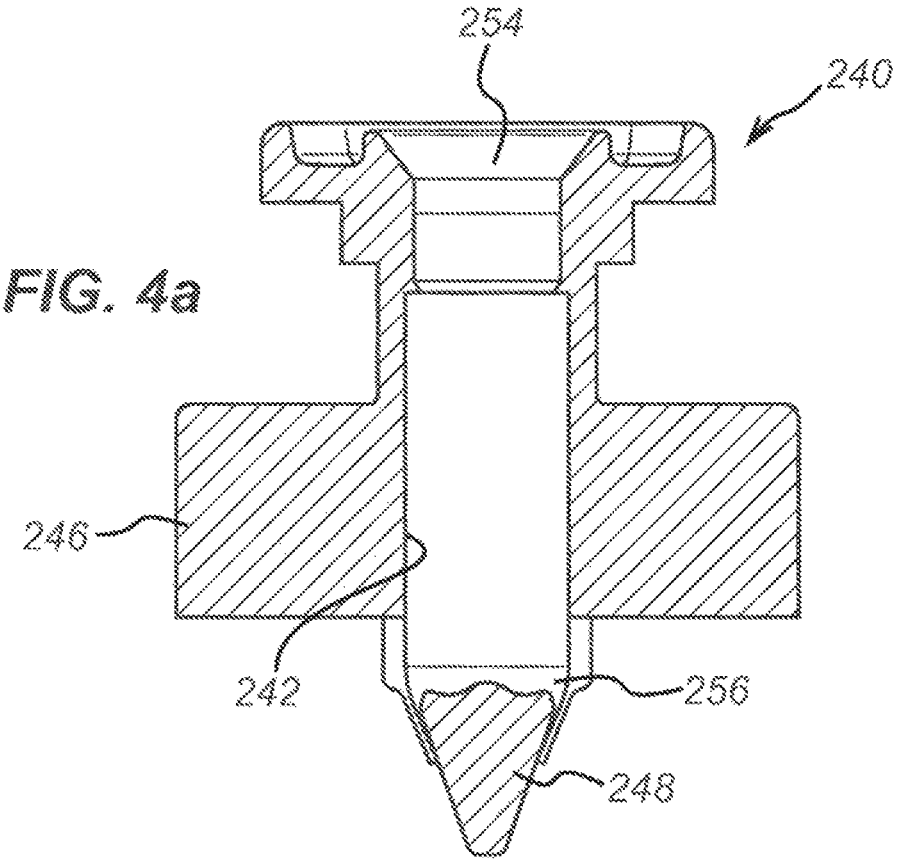

FIG. 4*a* is a cross-sectional view of a nozzle of the present invention after the plug has been detached.

Figure 4B:
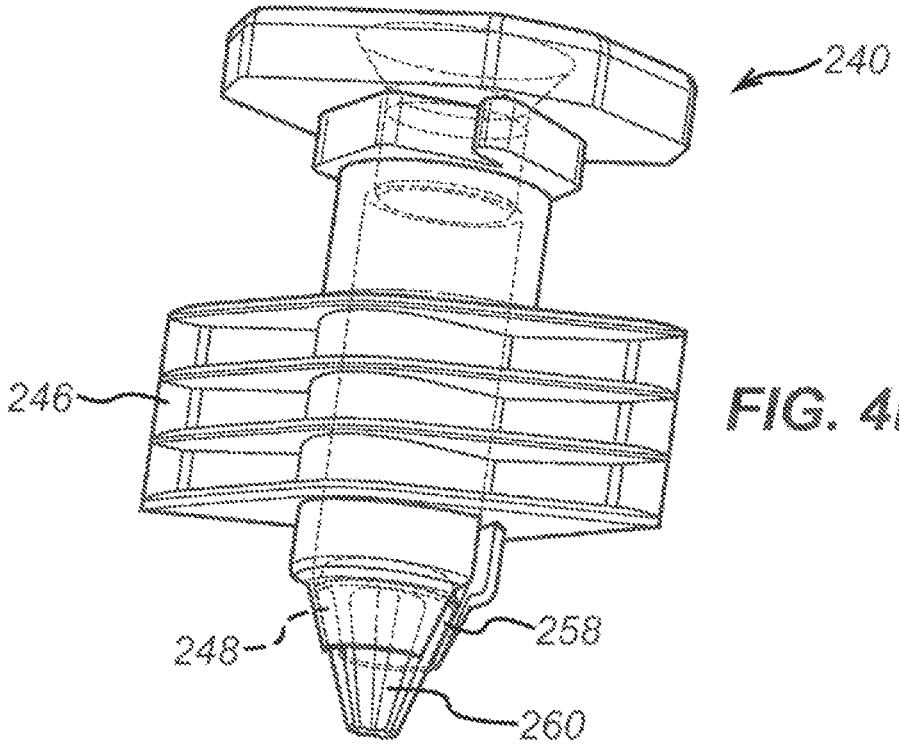

FIG. 4*b* is a corresponding perspective view of the nozzle depicted in FIG. 4*a*.

FIG. 1 depicts a prior art nozzle in the exemplary application of a beverage preparation package 100. The beverage preparation package 100 is formed from a front sheet 110 and a back sheet 112. The front sheet 110 is bonded to the back sheet 112 around the sheets' edges 116. A nozzle 140 is incorporated into the top edge of the beverage preparation package 100. The beverage preparation package 100 has a bottom seal 120 that can be released under the action of heat and pressure.

FIGS. 2*a* and 2*b* demonstrate the general action of the beverage preparation package. The beverage preparation package 100 has a beverage preparation ingredient 150 contained within the package body. The beverage preparation ingredient 150 is held above a filter element 130. The inlet of the nozzle 140 is sealed by the presence of a foil member 144. This foil member 144 is removed so as to allow liquid to be injected into the beverage preparation package. Alternatively. the foil member may be pierced by an injection member of brewing apparatus. Water is then injected into the beverage preparation package 100 through the nozzle 140 and the releasable seal 120 is released to allow beverage to escape from the bottom of the beverage preparation package 100.

The new nozzle described herein improves on the nozzle of the prior art.

FIGS. 39 and 3*b* illustrate a nozzle according to the present invention. The nozzle 240 has a conduit 242 formed through the nozzle body 246. There is a plug 248 connected to the nozzle body 246 in a detachable manner. The plug 248 is positioned within the conduit 242. The plug 248 is connected to the nozzle body 246 by a continuous portion of material 252 about the periphery of the plug 248. This portion of material 252 is relatively thin and can be broken when a sufficient force is applied to the plug 248, for example 50 newtons. A suitable thickness for the portion of material 252 can be about 0.2 mm.

The plug 248 is obstructing, in particular sealing, the inlet end 254 of the nozzle 240. At the other end of the conduit 242 is the outlet end 256 of the nozzle 240.

The plug 248 has a shape that tapers in the direction of the outlet end 256. In particular, the plug is a substantially conical shape, more specifically a substantially frustoconical shape.

The conduit 242 is tapered at the outlet end 256. In this manner, the plug 248 can be retained in the nozzle 240 at the outlet end 256.

The outlet end 256 exhibits two diametrically opposed slots 258 extending along the conduit. Each of these slots 258 is present all the way to the end of the conduit. The slots act as outlets for the fluid flowing through the conduit when the plug 248 is retained at the outlet end 256.

FIGS. 4*a* and 4*b* depict the nozzle after the plug 248 has been detached from the nozzle body 246. The plug 248 travels along the conduit 242 under the action of gravity and/or the flow of fluid from the inlet end 254 to the outlet end 256. The plug body 248 sits within the opening at the end of the conduit 242 at the outlet end 256. In this way, the plug 248 obstructs the opening 256 but leaves unobstructed portions of the slots 258 running along the sides of the conduit 242. In this way, the fluid flowing through the conduit is influenced by the presence of the plug 248 at the outlet end 256. The plug 248 stops fluid from leaving the opening at the outlet end of the conduit 242 and redirects the fluid sideways out of the slots 258.

In this particular embodiment, the plug 248 has grooves 260 extending along the length of the plug. These grooves 260 do not extend across the maximum width of the plug 248. Therefore, these grooves 260 assist in minimising the friction between the plug 248 and the conduit 242 when the plug 248 is traveling along the conduit 242 but do not form continuous channels that would significantly contribute to allowing fluid to exit the conduit 242 via these grooves 260.

The improved ease of manufacture of the nozzle 240 can be appreciated by considering FIG. 3*a*. As noted above, the nozzle 240 can be injection moulded as a single-piece. In the injection moulding process, the conduit 242 is formed by the presence of a pin on the outlet end side of the plug 248. This pin and the rest of the mould have a complementary shape in order to form the required configuration of the plug and the inside of the conduit. In particular, the pin is tapered so as to produce the tapered conduit at the outlet end. When the outlet end 256 is tapered, the presence of slots 258 contribute to the flexibility of this outlet end and thus contribute to the ability to remove the pin after the injection moulding process via the outlet end since the tapered end can splay in order to let the pin pass. It is particularly advantageous to perform the pin removal while the temperature of the injection moulded piece is relatively high since the flexibility of the tapered end will be higher.

The tapered section of the conduit has relatively thin walls compared to the walls of the rest of the conduit. A suitable wall thickness for the tapered section can be 0.4 mm.

It was previously not possible to injection mould a nozzle that was both sealed at the inlet end and had a configuration at the outlet end that provided a desirable fluid exit flow pattern. This has been achieved with the present invention by using a plug to initially seal the inlet end and then to subsequently direct the flow of fluid from the nozzle.

The foregoing description has described the invention in specific terms, although it should not be considered as limiting. The scope of the invention is defined by the attached claims. It is possible to combine the various aspects of the invention described above in any compatible combination in order to produce a nozzle.

The invention claimed is:

1. A nozzle comprising:

a nozzle body having a conduit that extends from an inlet end to an outlet end;

a plug detachably connected to the nozzle body by a portion of material, the plug being positioned in the conduit at or adjacent to the inlet end;

wherein the nozzle body, the plug, and the portion of material are formed from a same material as an integral article;

wherein upon the plug becoming detached from the nozzle body, the plug moves through the conduit towards the outlet end of the conduit, the plug being retained at the outlet end of the conduit.

2. The nozzle according to claim 1 wherein the plug obstructs the conduit to impede passage of material through the conduit from the inlet end to the outlet end when the plug is attached to the nozzle body.

3. The nozzle according to claim 1 wherein the plug seals the inlet end of the conduit so that no material can pass through the conduit while the plug is attached to the nozzle body.

4. The nozzle according to claim 1 wherein when the plug is connected to the nozzle body, the plug is positioned fully within the conduit so that no part of the plug protrudes from either of the inlet or outlet ends of the conduit.

5. The nozzle according to claim 1 wherein the plug and the conduit are configured so that when the plug is retained at the outlet end of the conduit, a fluid is able to flow through the conduit from the inlet end to the outlet end and be dispensed through an opening at the outlet end.

6. The nozzle according to claim 1 wherein the outlet end of the nozzle body and the plug are tapered.

7. The nozzle according to claim 1 wherein when the plug is retained in the outlet end of the conduit, a first portion of the plug remains located within the conduit and a second portion of the plug protrudes from the outlet end of the conduit.

8. The nozzle according to claim 1 wherein the plug comprises an outer surface having grooves extending lengthwise along the plug.

9. The nozzle according to claim 1 further comprising at least one slot extending through the nozzle body at the outlet end of the conduit, the at least one slot forming a passageway from an outer surface of the nozzle body to an inner surface of the nozzle body that defines the conduit.

10. The nozzle according to claim 1 wherein the conduit has an opening at the outlet end, and wherein the plug sits within the opening when the plug is retained at the outlet end.

11. The nozzle according to claim 10 further comprising at least one slot formed into the nozzle body along the outlet end, and wherein when the plug is retained at the outlet end of the conduit the plug obstructs the opening at the outlet end but leaves portions of the at least one slot unobstructed for passage of fluid.

12. The nozzle according to claim 1 wherein the plug seals the inlet end of the conduit when the plug is connected to the nozzle body.

13. The nozzle according to claim 1 wherein the plug becomes detached from the nozzle body by a force being applied to the plug.

14. The nozzle according to claim 13 wherein the force required to detach the plug from the nozzle body is greater than 20 Newtons.

15. The nozzle according to claim 1 wherein the plug moves from the inlet end of the conduit to the outlet end of the conduit by gravity upon the plug becoming detached from the nozzle body.

16. A beverage preparation package comprising:

a package body containing a beverage ingredient; and a nozzle comprising a nozzle body having a conduit with an inlet end and an outlet end and a plug detachably coupled to the nozzle body adjacent to the inlet end, the plug falling downwardly within the conduit from the inlet end to the outlet end upon being detached from the nozzle body; and wherein the nozzle is attached to the package body with the outlet end of the conduit positioned within the package body.

17. The beverage preparation package according to claim 16 wherein the package body further comprises a region that is releasable by heat and/or pressure to allow the beverage ingredient to escape from the package body.

18. The beverage preparation package according to claim 16 wherein the package body comprises a front sheet and a back sheet, wherein the front sheet is bonded to the back sheet along edges of the front and back sheets, and wherein the nozzle is incorporated between the front sheet and the back sheet.

19. The beverage preparation package according to claim 16 wherein the plug obstructs the conduit to impede passage of material through the conduit from the inlet end to the outlet end when the plug is attached to the nozzle body, and wherein when the plug is detached from the nozzle body the plug is retained within the conduit at the outlet end of the conduit.

* * * * *